US006451064B1

(12) United States Patent
Del Duca et al.

(10) Patent No.: US 6,451,064 B1
(45) Date of Patent: Sep. 17, 2002

(54) LIQUID MULTIPURPOSE-CLEANING COMPOSITIONS WITH EFFECTIVE FOAM CONTROL

(75) Inventors: Valerio Del Duca, Massalubrense (IT); Carlo Ricci, Rome (IT); Carla Scorsini, Rome (IT)

(73) Assignee: Procter & Gamble, Cincinnati, OH (US)

( * ) Notice: Subject to any disclaimer, the term of this patent is extended or adjusted under 35 U.S.C. 154(b) by 0 days.

(21) Appl. No.: 09/529,267

(22) Filed: Jun. 19, 2000

(30) Foreign Application Priority Data

Oct. 8, 1997 (EP) ..... 97870150

(51) Int. Cl.[7] ..... D06L 3/06; B08B 3/04; C11D 1/72; C11D 3/395

(52) U.S. Cl. ..... 8/137; 134/25.2; 134/25.3; 134/39; 134/40; 134/42; 510/303; 510/309; 510/340; 510/342; 510/343; 510/353; 510/356; 510/360; 510/361; 510/372; 510/413; 510/422; 510/437; 510/425; 510/481; 510/506; 510/535

(58) Field of Search ..... 510/303, 309, 510/340, 342, 343, 353, 356, 360, 361, 372, 413, 422, 437, 475, 481, 506, 535; 8/137; 134/25.2, 25.3, 39, 40, 42

(56) References Cited

U.S. PATENT DOCUMENTS

| | | | | |
|---|---|---|---|---|
| 4,824,593 A | * | 4/1989 | Appel et al. | 252/127 |
| 5,929,012 A | * | 7/1999 | Del Duca et al. | 510/303 |

FOREIGN PATENT DOCUMENTS

| | | | | |
|---|---|---|---|---|
| EP | 054725 | | 12/1980 | B01D/19/04 |
| EP | 256833 | | 2/1988 | C11D/3/00 |
| EP | 340000 | | 4/1988 | C11D/3/39 |
| EP | 325909 | | 2/1989 | C11D/1/72 |
| EP | WO 92/22496 | * | 12/1992 | |
| EP | 709450 | | 1/1996 | C11D/1/72 |
| EP | 709450 A1 | * | 5/1996 | |

* cited by examiner

*Primary Examiner*—Yogendra N. Gupta
*Assistant Examiner*—Brian P. Mruk
(74) *Attorney, Agent, or Firm*—Frank Taffy; C. Brant Cook; K. W. Zerby

(57) ABSTRACT

Liquid multipurpose cleaning compositions comprising a peroxygen bleach, a surfactant that exhibits a foaming property in the presence of a peroxygen bleach and a foam reducing system and processes for using same are provided.

28 Claims, No Drawings

LIQUID MULTIPURPOSE-CLEANING COMPOSITIONS WITH EFFECTIVE FOAM CONTROL

TECHNICAL FIELD

The present invention relates to the cleaning of different surfaces such as hard-surfaces, fabrics, clothes and the like. More particularly, the present invention refers to liquid multipurpose cleaning compositions suitable for use in various laundry and household bleaching applications both in their neat and diluted form while having easy rinsing properties.

BACKGROUND OF THE INVENTION

Bleaching components especially peroxygen bleaches are known in the art to serve as a strong oxidiser which assists in the chemical degradation, break-up and removal of stains and soils and also as an effective disinfectant. This dual role of peroxygen bleaches has contributed to the increased use of these components in the formulation of cleaning compositions.

Peroxygen bleaches compatible surfactants, such as nonionic surfactants and/or zwitterionic surfactants, are also known to contribute to the cleaning performance of such peroxygen bleach-containing compositions. Indeed, European co-pending application number 97870013.6 discloses such liquid peroxygen bleach-containing compositions comprising an ethoxylated nonionic surfactant and a zwifterionic betaine surfactant that deliver effective stain removal performance and bleaching performance on various surfaces.

However, a problem encountered with the use of such surfactants in peroxygen bleach-containing compositions is the foaming property of the surfactants which renders the rinsing step more difficult.

Accordingly, the formulator of cleaning compositions is faced with the challenge of formulating a cleaning composition which exhibits low-foaming properties. More particularly, it is an object of the present invention to provide a multi-purpose liquid composition providing effective bleaching performance and effective stain removal performance when used in any laundry and/or any household applications while exhibiting low-foaming properties.

It has now been found that these objects can be efficiently met by formulating a liquid composition having a pH below 7 and comprising a peroxygen bleach, a surfactant and a foam reducing system comprising a fatty acid together with a capped nonionic alkoxylated surfactant and/or a silicone. Such foam reducing system provides a reduction of the foaming due to the surfactants present in the compositions of the present invention. The use of this foam reducing system in the compositions of the present invention reduces the foaming of these compositions both in the strength and the consistency of the suds. Actually, it has surprisingly been found that there is a synergistic effect associated to the use of a fatty acid together with a capped alkoxylated nonionic surfactant and/or a silicone in terms of foam reduction across various usage conditions including both neat and diluted conditions.

An advantage of the compositions of the present invention is that they exhibit a great flexibility in the soils they may clean. Indeed, the compositions of the present invention provide excellent stain removal performance on a broad range of stains and soils and excellent bleaching performance when used in any laundry application, e.g., as a laundry detergent or a laundry additive, and especially when used as a laundry pretreater, or even in other household applications like in hard surface cleaning applications.

Advantageously, the compositions of the present invention exhibit effective stain removal performance on stains like kitchen soils comprising mainly edible oils, bathroom soils comprising mainly sebum and/or soap scum, floor soils comprising mainly particulate soils and more generally on any greasy stain (e.g., olive oil, mayonnaise, vegetal oil, make up), enzymatic stains (grass, blood) as well as bleachable stains (e.g., tea, coffee).

A further advantage is that the compositions herein are physically and chemically stable upon prolonged periods of storage. Also they are clear compositions in a broad range of temperatures, e.g. up to 45° C.

Yet another advantage of the compositions according to the present invention is that they are able to perform in a variety of conditions, i.e., in hard and soft water as well as when used neat or diluted. Advantageously, they also provide satisfactory shine performance and surface safety when used as hard surface cleaners and satisfactory fabric and color safety when used as laundry cleaners.

BACKGROUND ART

EP-A-709 450 discloses compositions with branched alkyl capped nonionic surfactants with low sudsing properties. Fatty acids are also disclosed at levels of 3% to 50% and bleaching agents like peroxygen bleaches at levels of 1% to 30%. The pH of the compositions exemplified is 7.8.

EP-A-621456 discloses detergent compositions consisting essentially of nonionic surfactants and suds depressing capped nonionic surfactants. Optional ingredients may be added like fatty acids or bleaches. When the compositions are liquids, the pH is raised to a value of at least 7.

EP-A-724 011 discloses aqueous cleaning compositions comprising a bleach (e.g. peroxygen bleach), a surfactant and an alkylene glycol diether. The pH of the composition is preferably above 7. Fatty acids are mentioned as optional ingredients.

None of these above prior art documents recognises the synergistic effect associated to the combination of fatty acid together with a capped alkoxylated nonionic surfactant and/or silicone, in a peroxygen bleach-containing composition comprising a surfactant, in term of foam reduction.

SUMMARY OF THE INVENTION

The present invention encompasses a liquid composition having a pH below 7, and comprising a peroxygen bleach, a surfactant and a foam reducing system comprising a fatty acid together with a capped alkoxylated nonionic surfactant according to the formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, $R_2$ is a $C_1$–$C_{10}$ linear or branched alkyl group, $R_3$ is a $C_1$–$C_{10}$ alkyl or alkenyl group and n and m are integers independently ranging in the range of from 1 to 20 and/or a silicone.

The present invention further encompasses processes of cleaning a surface, e.g. a fabric or a hard-surface, starting from a liquid composition as defined herein. For example, the processes of cleaning fabrics include the steps of contacting said fabrics with the liquid compositions herein neat or diluted, and subsequently rinsing said fabrics. The processes of treating a hard-surface herein include the steps of applying the composition herein to the hard-surface and optionally rinsing the hard-surface.

DETAILED DESCRIPTION OF THE INVENTION

The Liquid Cleaning Composition

The compositions according to the present invention are liquid compositions as opposed to a solid or a gas. As used herein "liquid" includes "pasty" compositions. The liquid compositions herein are preferably aqueous compositions. The liquid compositions according to the present invention have a pH below 7, preferably from 1 to 6.5, more preferably from 2 to 6 and most preferably from 2.5 to 5.5. Formulating the compositions according to the present invention in the acidic pH range contributes to the chemical stability of the compositions and to the stain removal performance of the compositions. The pH of the compositions may be adjusted by any acidifying agent known to those skilled in the art. Examples of acidifying agents are organic acids such as citric acid and inorganic acids such as sulphuric acid.

The Peroxygen Bleach

As a first essential element, the compositions according to the present invention comprise a peroxygen bleach or a mixture thereof. Indeed, the presence of peroxygen bleach contributes to the excellent bleaching benefits of said compositions. Suitable peroxygen bleaches for use herein are hydrogen peroxide, water soluble sources thereof, or mixtures thereof. As used herein, a hydrogen peroxide source refers to any compound which produces perhydroxyl ions when said compound is in contact with water.

Suitable water-soluble sources of hydrogen peroxide for use herein include percarbonates, persilicates, persulphates such as monopersulfate, perborates, peroxyacids such as diperoxydodecandioic acid (DPDA), magnesium perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance when used in any laundry application.

Suitable aliphatic diacyl peroxides for use herein are dilauroyl peroxide, didecanoyl peroxide, dimyristoyl peroxide, or mixtures thereof. Suitable aromatic diacyl peroxide for use herein is for example benzoyl peroxide. Such diacyl peroxides have the advantage to be particularly safe to fabrics and color while delivering excellent bleaching performance when used in any laundry application.

Typically, the compositions herein comprise from 0.01% to 20% by weight of the total composition of said peroxygen bleach or mixtures thereof, preferably from 1% to 15% and more preferably from 2% to 10%.

The Surfactant

As a second essential element, the compositions according to the present invention comprise a surfactant or a mixture thereof. Naturally, for the purpose of the present invention the surfactants are stable to the peroxygen bleach.

Typically, the compositions of the present invention comprise from 0.01% to 60% by weight of the total composition of a surfactant or a mixture thereof, preferably from 0.1% to 30%, more preferably from 0.5% to 15% and most preferably from 1% to 10%.

Suitable surfactants for use herein include any nonionic, anionic, zwitterionic, cationic and/or amphoteric surfactants.

Particularly suitable surfactants for use herein are nonionic surfactants such as alkoxylated nonionic surfactants and/or polyhydroxy fatty acid amide surfactants and/or amine oxides and/or zwitterionic surfactants like the zwitterionic betaine surfactants described herein after.

Suitable alkoxylated nonionic surfactants for use herein are ethoxylated nonionic surfactants according to the formula $RO—(C_2H_4O)_nH$, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated nonionic surfactants and ethoxy/propoxylated ones may also be used herein instead of the ethoxylated nonionic surfactants as defined herein above or together with said surfactants.

Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol® 91-2.5 (HLB=8.1; R is a mixture of C9 and $C_{11}$ alkyl chains, n is 2.5), or Lutensol® TO3 (HLB=8; R is a $C_{13}$ alkyl chains, n is 3), or Lutensol® AO3 (HLB=8; R is a mixture of $C_{13}$ and $C_{15}$ alkyl chains, n is 3), or Tergitol® 25L3 (HLB=7.7; R is in the range of $C_{12}$ to $C_{15}$ alkyl chain length, n is 3), or Dobanol® 23-3 (HLB=8.1; R is a mixture of $C_{12}$ and $C_{13}$ alkyl chains, n is 3), or Dobanol® 23-2 (HLB=6.2; R is a mixture of $C_{12}$ and $C_{13}$ alkyl chains, n is 2), or Dobanol® 45-7 (HLB=11.6; R is a mixture of $C_{14}$ and $C_{15}$ alkyl chains, n is 7) Dobanol® 23-6.5 (HLB=11.9; R is a mixture of $C_{12}$ and $C_{13}$ alkyl chains, n is 6.5), or Dobanol® 25-7 (HLB=12; R is a mixture of $C_{12}$ and $C_{15}$ alkyl chains, n is 7), or Dobanol® 91-5 (HLB=11.6; R is a mixture of $C_9$ and $C_{11}$ alkyl chains, n is 5), or Dobanol® 91-6 (HLB=12.5 ; R is a mixture of $C_9$ and $C_{11}$ alkyl chains, n is 6), or Dobanol® 91-8 (HLB=13.7 ; R is a mixture of $C_9$ and $C_{11}$ alkyl chains, n is 8), Dobanol® 91-10 (HLB=14.2 ; R is a mixture of $C_9$ to $C_{11}$ alkyl chains, n is 10), or mixtures thereof. Preferred herein are Dobanol® 91-2.5 , or Lutensol® TO3, or Lutensol® AO3, or Tergitol® 25L3, or Dobanol® 23-3, or Dobanol® 23-2, or mixtures thereof. These Dobanol® surfactants are commercially available from SHELL. These Lutensol® surfactants are commercially available from BASF and these Tergitol® surfactants are commercially available from UNION CARBIDE.

Suitable chemical processes for preparing the alkoxylated nonionic surfactants for use herein include condensation of corresponding alcohols with alkylene oxide, in the desired proportions. Such processes are well-known to the man skilled in the art and have been extensively described in the art.

The compositions herein may desirably comprise one of those ethoxylated nonionic surfactants or a mixture of those ethoxylated nonionic surfactants having different HLBs (hydrophilic-lipophilic balance). In a preferred embodiment, the compositions herein comprise an ethoxylated nonionic surfactant according to the above formula and having an HLB up to 10 (i.e., a so called hydrophobic ethoxylated nonionic surfactant), preferably below 10, more preferably below 9, and an ethoxylated nonionic surfactant according to the above formula and having an HLB above 10 to 16 (i.e., a so called hydrophilic ethoxylated nonionic surfactant), preferably from 11 to 14. Indeed, in this preferred embodiment the compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

Other particularly suitable nonionic surfactants for use herein include polyhydroxy fatty acid amide surfactants, or mixtures thereof, according to the formula:

$$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl.

Suitable reducing sugars include glucose, fructose, maltose, lactose, galactose, mannose and xylose. As raw materials, high dextrose corn syrup, high fructose corn syrup, and high maltose corn syrup can be utilised as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2—(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2—(CHOH)_4—CH_2OH$.

In formula $R^2—C(O)—N(R^1)—Z$, $R^1$ can be, for example, N-methyl, N-ethyl, N-propyl, N-isopropyl, N-butyl, N-2-hydroxy ethyl, or N-2-hydroxy propyl. $R^2—C(O)—N<$ can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from-Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Other suitable nonionic surfactants for use herein include amine oxides having the following formula $R_1R_2R_3NO$ wherein each of R1, R2 and R3 is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein R1 is an hydrocarbon chain comprising from 1 to 30 carbon atoms, preferably from 6 to 20, more preferably from 8 to 16, most preferably from 8 to 12, and wherein R2 and R3 are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain. Suitable amine oxides for use herein are for instance natural blend C8–C10 amine oxides as well as C12–C16 amine oxides commercially available from Hoechst.

Another class of surfactants particularly suitable for use herein include zwitterionic betaine surfactants containing both a cationic hydrophilic group, i.e., a quaternary ammonium group, and anionic hydrophilic group on the same molecule at a relatively wide range of pH's. The typical anionic hydrophilic groups are carboxylates and sulfonates, although other groups like sulfates, phosphonates, and the like can be used. A generic formula for the zwitterionic betaine surfactants for use herein is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a—C(O)—NH—(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is a $C_1$–$C_4$ carboxylic acid group or C1–C4 sulfonate group, or a $C_1$–$C_3$ alkyl and more preferably methyl. Preferred $R_4$ is $(CH2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N,N-dimethylammonia)acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or C10–C14 fatty acylamidopropylene(hydropropylene) sulfobetaine. For example C10–C14 fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Miratine H2C-HA®.

Particularly preferred zwitterionic betaine surfactants for use herein are salt free, i.e. that the zwitterionic betaine surfactant raw material contains less than 5% by weight of salts, preferably less than 2%, more preferably less than 1% and most preferably from 0.01% to 0.5%.

By "salts" is meant herein any material having as base unit, a couple of positive ion (or positive molecular ion) and negative ion (or negative molecular ion) containing one or more halogen atoms. Such salts include Sodium Chloride, Potassium Chloride, Sodium Bromide and the like.

Such salts free zwitterionic betaine surfactants are obtainable by conventional manufacturing processes like inverse osmosis or fractionated precipitation. For example inverse osmosis is based on the principle of contacting the zwitterionic betaine surfactant raw material (commercially available) with a polar solvent (it is to be understood that such a solvent is free of salts) separated by a semi-permeable membrane for example acetate-cellulose. An adequate pressure is applied on the system to allow the salts to migrate from the surfactant raw material to the polar solvent phase. This way the zwitterionic betaine surfactant raw material is purified, i.e. the salts is subtracted from the raw material.

Advantageously, it has now been surprisingly found that the use of such salt free zwitterionic betaine surfactants deliver improved fabric safety and/or color safety when bleaching fabrics with a peroxygen bleach-containing composition comprising the same, as compared to the use of the same zwitterionic betaine surfactants with higher amount of salts. Thus, in its broadest aspect, the present invention also encompasses the use of a composition comprising a salt free zwitterionic betaine surfactant and a peroxygen bleach for bleaching fabrics whereby color safety is improved (i.e. color damage/decoloration is reduced) and/or fabric safety is improved.

In a preferred embodiment herein the surfactants present in the compositions of the present invention are a mixture of ethoxylated nonionic surfactants and betaine zwitterionic surfactants. Indeed, such betaine zwitterionic surfactants have the ability to further boost the stain removal performance delivered by the ethoxylated nonionic surfactants on greasy stains (e.g., lipstick, olive oil, mayonnaise, vegetal oil, sebum, make-up), while providing improved bleaching performance to the liquid peroxygen bleach-containing compositions of the present invention comprising them.

Indeed, a significant co-operation has been observed between these ingredients to get optimum stain removal performance on a variety of soils, from particulate to non-particulate soils from hydrophobic to hydrophilic soils under any household application and especially laundry application on both hydrophilic and hydrophobic fabrics.

Optimum stain removal performance and bleaching performance are obtained when the ethoxylated nonionic surfactant and the zwitterionic betaine surfactant are present in the compositions of the present invention comprising a peroxygen bleach (pH below 7), at weight ratio of the ethoxylated nonionic surfactant to the zwitterionic betaine surfactant of from 0.01 to 20, preferably from 0.1 to 15, more preferably from 0.5 to 5 and most preferably from 0.6 to 3.

Importantly, the improved stain removal benefit and bleaching benefit are delivered with a liquid composition which is a water-like, clear and transparent composition. The appearance of a composition can be evaluated via turbidimetric analysis. For example, the transparency of a composition can be evaluated by measuring its absorbency via a spectrophotometer at 800 nm wave length.

Although less desirable than the surfactants mentioned above for their stain removal properties, other surfactants may be used in the compositions herein. Suitable anionic surfactants for use in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethylammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$, $C_{12}$–$C_{18}$ alkyl polyethoxylate (2.25) sulfate, $C_{12}$–$C_{18}E$ (2.25)M), $C_{12}$–$C_{18}$ alkyl polyethoxylate (3.0) sulfate, C12–C15 alkyl ethoxylate (3) sulphate, $C_{12}$–$C_{18}$ alkyl polyethoxylate (4.0) sulfate, $C_{12}$–$C_{18}E(4.0)M$, wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants for use herein also include acyl sarcosinate or mixtures thereof, in its acid and/or salt form, preferably long chain acyl sarcosinates having the following formula:

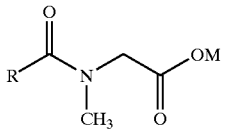

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates for use herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

The Foam Reducing System

As a third essential element, the compositions according to the present invention comprise a foam reducing system comprising a fatty acid together with a capped alkoxylated nonionic surfactant as defined herein after and/or silicone.

Typically, the compositions herein comprise from % to 10% by weight of the total composition of a fatty acid or a mixture thereof, preferably from % to 5% and more preferably from % to 5%.

Typically, the compositions herein comprise from % to 20% by weight of the total composition of a capped alkoxylated nonionic surfactant as defined herein or a mixture thereof, preferably from % to 10% and more preferably from % to 5%.

Typically, the compositions herein comprise from % to 5% by weight of the total composition of a silicone or a mixture thereof, preferably from % to 1% and more preferably from % to 0.5%.

Suitable fatty acids for use herein are the alkali salts of a $C_8$–$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22 carbon atoms, preferably from 8 to 20 and more preferably from 8 to 18.

Suitable fatty acids may be selected from caprylic acid, capric acid, lauric acid, myristic acid, palmitic acid, stearic acid and mixtures of fatty acids suitably hardened, derived from natural sources such as plant or animal esters (e.g., palm oil, coconut oil, soybean oil, castor oil, tallow, ground oil, whale and fish oils and/or babassu oil.

For example Coconut Fatty Acid is commercially available from UNICHEMA under the name PRIFAC 5900®.

Suitable capped alkoxylated nonionic surfactants for use herein are according to the formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, preferably $R_1$ is a $C_8$–$C_{18}$ alkyl or alkenyl group, more preferably a $C_{10}$–$C_{15}$ alkyl or alkenyl group, even more preferably a $C_{10}$–$C_{15}$ alkyl group;

wherein $R_2$ is a $C_1$–$C_{10}$ linear or branched alkyl group, preferably a $C_2$–$C_{10}$ linear or branched alkyl group, preferably a $C_3$ group;

wherein $R_3$ is a $C_1$–$C_{10}$ alkyl or alkenyl group, preferably a $C_1$–$C_5$ alkyl group, more preferably methyl;

and wherein n and m are integers independently ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic alkoxylated surfactants of the above formula are those commercially available under the tradename Genapol® L 2.5 NR from Hoechst, and Plurafac® from BASF.

Suitable silicones for use herein include any silicone and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the silicone is advantageously releasably incorporated in a water-soluble or water-dispersible, substantially non-surface-active detergent impermeable carrier. Alternatively, the silicone can be dissolved or dispersed in a liquid carrier and applied by spraying on to one or more of the other components.

Actually in industrial practice, the term "silicone" has become a generic term which encompasses a variety of relatively high-molecular-weight polymers containing siloxane units and hydrocarbyl groups of various types. Indeed, silicone compounds have been extensively described in the art, see for instance U.S. Pat. Nos. 4,076,648, 4,021,365, 4,749,740, 4,983,316, EP 150 872, EP 217 501 and EP 499 364. The silicone compounds disclosed therein are suitable in the context of the present invention. Generally, the silicone compounds can be described as siloxanes having the general structure:

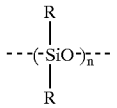

wherein n is from 20 to 2000, and where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end blocking units and having a viscosity at 25° C. of from $5\times10^{-5}$ $m^2/s$ to 0.1 $m^2/s$, i.e. a value of n in the range 40 to 1500. These are preferred because of their ready availability and their relatively low cost.

A preferred type of silicone compounds useful in the compositions herein comprises a mixture of an alkylated siloxane of the type hereinabove disclosed and solid silica.

The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 $m^2/g$. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from $2\times10^{-4}$ $m^2/s$ to 1 $m^2/s$. Preferred silicone compounds may have a viscosity in the range of from $5\times10^{-3}$ $m^2/s$ to 0.1 $m^2/s$. Particularly suitable are silicone compounds with a viscosity of $2\times10^{-2}$ $m^2/s$ or $4.5\times10^{-2}$ $m^2/s$.

Suitable silicone compounds for use herein are commercially available from various companies including Rhone Poulenc, Fueller and Dow Corning. Examples of silicone compounds for use herein are Silicone DB® 100 and Silicone Emulsion 2-3597® both commercially available from Dow Corning.

Another silicone compound is disclosed in Bartollota et al. U.S. Pat. No. 3,933,672. Other particularly useful silicone compounds are the self-emulsifying silicone compounds, described in German Patent Application DTOS 2 646 126 published Apr. 28, 1977. An example of such a compound is DC-544®, commercially available from Dow Corning, which is a siloxane-glycol copolymer.

Typically preferred silicone compounds are described in European Patent application EP-A-573699. Said compositions can comprise a silicone/silica mixture in combination with fumed nonporous silica such as Aerosil$^R$.

The present invention is based on the finding that fatty acids act synergistically with such a capped alkoxylated nonionic surfactant and/or silicone when added in a liquid composition comprising a peroxygen bleach and a surfactant to exhibit a reduced generation of foam of said composition, when used both in neat and diluted conditions, as compared to the same composition, but comprising only one of said foam reducing agents. Indeed, the reduction of foam height when measured in neat and diluted conditions (typically at a dilution level of 12.5:1000 (composition:water)) is faster and more important with a given peroxygen bleach-containing composition comprising a surfactant (e.g. nonionic and/or zwitteionic surfactant) and a foam reducing system according to the present invention (i.e. fatty acid together with capped alkoxylated nonionic surfactant and/or silicone), as compared to the reduction of foam height observed with the same composition but with only one of said foam reducing agent (either only fatty acid or only the capped alkoxylated nonionic surfactant or silicone) at the same total level of foam reducing agent.

More particularly, it has been found that the combination of a fatty acid with the capped alkoxylated nonionic surfactant according to the present invention performs dual functions when it is incorporated in the compositions herein, said functions being not only to have a low foaming property but also to reduce the foaming of the surfactants herein both when the compositions herein are used in neat and diluted conditions.

Indeed, the combinations of foam reducing agents according to the present invention increase the collapse rate of the foam generated by the surfactants. As a result, when incorporated in the compositions of the invention, a reduction of the generation of foam as well as an increase in the collapse rate is observed.

Optimum defoaming properties (consistency and strenght of the suds) are obtained with the compositions according to the present invention comprising the fatty acid and the capped alkoxylated surfactant at a weight ratio of the fatty acid to the capped nonionic surfactant of 0.01 to 10, preferably from 0.1 to 5 and more preferably from 0.1 to 1. Also when the combination fatty acid and silicone is used as the foam reducing system herein, optimum defoaming properties (consistency and strenght of the suds) are obtained with the compositions according to the present invention comprising the fatty acid and the silicone at a weight ratio of the fatty acid to the silicone of to , preferably from to 1 and more preferably from to.

In another preferred embodiment of the present invention, the three foam reducing agents described herein are used together to get optimum defoaming properties to the compositions of the present invention and are typically present at a weight ratio of fatty acid:capped nonionic surfactant: silicone of $1:1\cdot10^3:1\cdot10^{-5}$ to 10:1:1 and preferably from $1:1\cdot10^2:1\cdot10^2:1\cdot10^{-4}$ to 1:1:1.

Foaming (foam height) can be measured by using a Foam-meter, a machine composed by 5 cylinders rotating around a horizontal axe, which can be filled with the product under evaluation.

Usually, the user sets the speed at 45 round per minute and the rotation time at 900 seconds. The test method may consists of 2 different steps related to different product concentrations:

Foaming of Neat Product

The Foam Meter cylinder is filled with the product under test until the first sign on the cylinder (about 500 grams of product) and the rotation is started.

Foaming of Diluted Product

Another cylinder is filled with tap water until the first sign on the cylinder (about 500 grams of tap water) and the appropriate quantity of test product depending on the dilution level under test is added before starting the rotation.

As soon as the instrument stops, the foam height can be read on the scale outside each cylinder and recorded as the foam height at time 0. Then, the foam height for each cylinder can be recorded upon time, typically after 1, 2, 3, 4, 5, 10, 15, 20, 25, 30 minutes.

Another advantage of the present invention is that such capped nonionic surfactants, fatty acids and/or silicones are stable in presence of a peroxygen bleaching component.

A further advantage of the compositions of the present invention is that they are physically and chemically stable upon prolonged periods of storage.

Chemical stability of the compositions herein may be evaluated by measuring the concentration of available oxygen (often abbreviated to AvO2) at given storage time after having manufactured the compositions. The concentration of available oxygen can be measured by chemical titration methods known in the art, such as the iodometric method, thiosuiphatimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley mnt. Science, 1970.

By "physically stable", it is meant herein that no phase separation occurs in the compositions for a period of 7 days at 50° C.

Optional Ingredients

The compositions herein may further comprise a variety of other optional ingredients such as chelating agents, radical scavengers, antioxidants, builders, stabilisers, bleach activators, soil suspenders, soil suspending polyamine polymers, polymeric soil release agents, catalysts, dye transfer agents, solvents, brighteners, perfumes, pigments and dyes.

Chelating Agents

Accordingly, the compositions of the present invention may comprise a chelating agent as a preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

A chelating agent may be desired in the compositions of the present invention as it may contribute to reduce tensile strength loss of fabrics and/or color damage, especially in a laundry pretreatment application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents for use herein include salicylic acid, aspartic acid, glutamic acid, glycine, malonic acid or mixtures thereof.

Another chelating agent for use herein is of the formula:

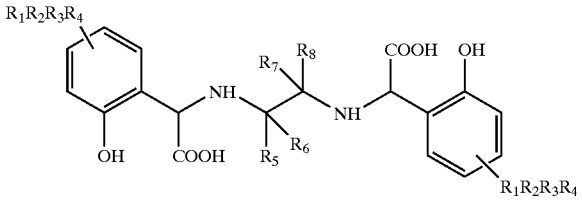

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents for use herein are amino aminotri(methylene phosphonic acid), di-ethylenetriamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention may comprise up to 5% by weight of the total composition of a chelating agent, or a mixture thereof, preferably from 0.01% to 1.5% by weight and more preferably from 0.01% to 0.5%.

Radical Scavengers

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butylhydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts ranging from up to 10% by weight of the total composition, preferably from 0.001% to 2% and more preferably from 0.001% to 0.5% by weight.

The presence of radical scavengers may contribute to reduce tensile strength loss of fabrics and/or color damage when the compositions of the present invention are used in any laundry application, especially in a laundry pretreatment application.

Antioxidants

The compositions according to the present invention may further comprise an antioxidant or mixtures thereof. Typically, the compositions herein may comprise up to 10% by weight of the total composition of an antioxidant or mixtures thereof, preferably from 0.002% to 5%, more preferably from 0.005% to 2%, and most preferably from 0.01% to 1%.

Suitable antioxidants for use herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof. Preferred antioxidants for use herein are citric acid, ascorbic acid, ascorbil palmitate, lecithin or mixtures thereof.

Bleach Activators

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition. The compositions according to the present invention may comprise from 0.01% to 20% by weight of the total composition of said bleach activator, or mixtures thereof, preferably from 1% to 10%, and more preferably from 3% to 7%.

Cleaning Processes

In the present invention, the liquid cleaning composition of the present invention needs to be contacted with the surface to clean.

By "surfaces", it is meant herein any inanimate surface. These inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on.

Thus, the present invention also encompasses a process of cleaning a fabric, as the inanimate surface. In such a process a composition, as defined herein, is contacted with the fabrics to be cleaned. This can be done either in a so-called "pretreatment mode", where a composition, as defined herein, is applied neat onto said fabrics before the fabrics are rinsed, or washed then rinsed, or in a "soaking mode" where a composition, as defined herein, is first diluted in an aqueous bath and the fabrics are immersed and soaked in the bath, before they are rinsed, or in a "through the wash mode", where a composition, as defined herein, is added on top of a wash liquor formed by dissolution or dispersion of a typical laundry detergent. It is also essential in both cases, that the fabrics be rinsed after they have been contacted with said composition, before said composition has completely dried off.

Indeed, it has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation generates peroxy-radicals which may contribute to the degradation of cellulose. Thus, not leaving the liquid compositions, as described herein, to dry onto the fabrics, in a process of pretreating soiled fabrics, contributes to reduce the tensile strength loss and/or color damage when pretreating fabrics with liquid peroxygen bleach-containing compositions.

In the pretreatment mode, the process comprises the steps of applying said liquid composition in its neat form onto said fabrics, or at least soiled portions thereof, and subsequently rinsing, or washing then rinsing said fabrics. In this mode, the neat compositions can optionally be left to act onto said fabrics for a period of time ranging from 1 min. to 1 hour, before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

In another mode, generally referred to as "soaking", the process comprises the steps of diluting said liquid composition in its neat form in an aqueous bath so as to form a diluted composition. The dilution level of the liquid composition in an aqueous bath is typically up to 1:85, preferably up to 1:50 and more preferably about 1:25 (composition:water). The fabrics are then contacted with the aqueous bath comprising the liquid composition, and the fabrics are finally rinsed, or washed then rinsed. Preferably in that embodiment, the fabrics are immersed in the aqueous bath comprising the liquid composition, and also preferably, the fabrics are left to soak therein for a period of time ranging from 1 minute to 48 hours, preferably from 1 hour to 24 hours.

In yet another mode which can be considered as a sub-embodiment of "soaking", generally referred to as "bleaching through the wash", the liquid composition is used as a so-called laundry additive. And in that embodiment the aqueous bath is formed by dissolving or dispersing a conventional laundry detergent in water. The liquid composition in its neat form is contacted with the aqueous bath, and the fabrics are then contacted with the aqueous bath containing the liquid composition. Finally, the fabrics are rinsed.

In another embodiment the present invention also encompasses a process of cleaning a hard-surface, as the inanimate surface. In such a process a composition, as defined herein, is contacted with the hard-surfaces to be cleaned. Thus, the present invention also encompasses a process of cleaning a hard-surface with a composition, as defined herein, wherein said process comprises the step of applying said composition to said hard-surface, preferably only soiled portions thereof, and optionally rinsing said hard-surface.

In the process of cleaning hard-surfaces according to the present invention the composition, as defined herein, may be applied to the surface to be cleaned in its neat form or in its diluted form typically up to 200 times their weight of water, preferably into 80 to 2 times their weight of water, and more preferably 60 to 2 times.

When used as hard surfaces cleaners the compositions of the present invention are easy to rinse and provide good shine characteristics on the cleaned surfaces.

Depending on the end-use envisioned, the compositions herein can be packaged in a variety of containers including conventional bottles, bottles equipped with roll-on, sponge, brusher or sprayers.

Test Methods

The stain removal performance may be evaluated by the following test methods on various type of stains.

A suitable test method for evaluating the stain removal performance on a soiled fabric for example under pretreatment condition is the following: A composition according to the present invention is applied neat to a fabric preferably to the soiled portion of the fabric, left to act from 1 to 10 minutes, and said pretreated fabric is then washed according to common washing conditions, at a temperature of from 30° to 70° C. for from 10 to 100 minutes. The stain removal is then evaluated by comparing side by side the soiled fabric pretreated with the composition of the present invention with those pretreated with the reference. A visual grading may be used to assign difference in panel units (psu) in a range from 0 to 4.

A suitable test method for evaluating cleaning performance on a hard-surface is the following: synthetic soil representative of typical hard surface household kitchen dirt soil can be used. The test-soil is applied on an enamel-coated metal plate (cleaned with a detergent and then with alcohol) with a paint roller, and the plates are baked at 130° C. for 30 minutes. After 24 hours they can be used for the test. This test is evaluated in a Gardner straight-line scrub machine. The results are given in number of strokes a given composition needs to clean a standard soiled plate. The lower the number of strokes needed the more efficient in terms of satin removal is the composition used to clean the dirt from the test plates.

The bleaching performance may be evaluated as for the stain removal performance but the stains used are bleachable stains like coffee, tea and the like.

The invention is further illustrated by the following examples.

EXAMPLES

Following compositions were made by mixing the listed ingredients in the listed proportions (weight % unless otherwise specified).

| Compositions (% weight) | I | II | III | IV | V | VI | VII | VIII |
|---|---|---|---|---|---|---|---|---|
| Dobanol ® 91-10 | — | — | — | 1.6 | 0.8 | — | 1.6 | — |
| Dobanol ® 45-7 | 1.6 | 2.0 | 2.6 | — | 0.8 | 1.6 | — | 2.0 |
| Dobanol ® 23-3 | 2.0 | — | 1.0 | 2.0 | 2.0 | 2.0 | 2.0 | — |
| Lauryl Betaine | — | — | 2.4 | 2.4 | 2.4 | 5.0 | 5.0 | 5.0 |
| Mirataine H2C-HA ® | 5.0 | 2.4 | — | — | — | — | — | — |
| Coconut fatty acid | 0.5 | 0.20 | 0.25 | 0.25 | 0.25 | 0.25 | 0.25 | 0.1 |
| Capped alcohol* | 0.5 | 0.20 | 0.25 | — | 0.25 | — | 0.25 | 0.4 |
| Silicone DB ® 100 | — | — | 0.004 | — | — | 0.004 | 0.004 | 0.004 |
| $H_2O_2$ | 7.0 | 7.0 | 6.0 | 7.0 | 7.0 | 7.0 | 7.0 | 7.0 |
| HEDP | 0.16 | — | 0.16 | 0.16 | — | 0.16 | 0.16 | 0.16 |
| DTPMP | — | 0.18 | — | — | 0.18 | — | — | — |
| BHT | 0.1 | 0.1 | 0.1 | 0.1 | 0.3 | 0.1 | 0.1 | 0.1 |
| Citric acid | 0.05 | 0.05 | 0.50 | 0.05 | 0.05 | 0.05 | 0.05 | 0.05 |
| Water and minors | - - - up to 100% - - - | | | | | | | |
| pH (neat product) | 4 | 4 | 5 | 6 | 4 | 5 | 4 | 6 |

HEDP is 1-hydroxy-ethane diphosphonate.

DTPMP is diethylene triamine penta methylene phosphonate.

Mirataine H2C-HA® is Lauryl-immino-dipropionate

Silicone DB® 100 is a silicone compound commercially available from Dow Corning.

Silicone emulsion 2-3597® is a silicone compound commercially available from Dow Corning.

Capped alcohol* is Plufarac LF 231® commercially available from BASF.

Glucose amine* is HOE®, a polyhydroxy fatty acid amide surfactant commercially available from Hoechst.

Dobanol® 23-3 is a C12–C13 EO3 nonionic surfactant commercially available from SHELL.

Dobanol® 91-10 is a C9–C11 EO10 nonionic surfactant commercially available from SHELL.

Dobanol® 45-7 is a C14–C15 EO7 nonionic surfactant commercially available from SHELL.

C25-AE3-S is C12–C15 alkyl-ethoxy (3EO)-sulphate. BHT is di-tert-butyl hydroxy toluene.

| Compositions | IX | X | XI | XII | XIII | XIV | XV |
|---|---|---|---|---|---|---|---|
| Dobanol ® 91-10 | — | — | 1.6 | — | — | 1.6 | — |
| Dobanol ® 45-7 | 1.6 | 1.6 | — | — | 1.6 | — | 2.0 |
| Dobanol ® 23-3 | 1.5 | 1.5 | 2.0 | 2.0 | 2.0 | 2.0 | 2.0 |

-continued

| Compositions | IX | X | XI | XII | XIII | XIV | XV |
|---|---|---|---|---|---|---|---|
| Glucose Amide* | 1.5 | 1.5 | 1.5 | 1.5 | 1.5 | 1.5 | 1.5 |
| C25-AE3-S | 2.0 | 2.0 | 2.0 | 2.0 | 2.0 | 3.0 | 1.0 |
| Fatty Acid | 0.10 | 0.10 | 0.10 | 0.10 | 0.25 | 0.25 | 0.1 |
| Capped alcohol* | 0.10 | 0.10 | — | 2.0 | — | 0.25 | 0.4 |
| Silicone DB ® 100 | — | 0.004 | 0.004 | — | 0.004 | 0.004 | 0.004 |
| $H_2O_2$ | 7.0 | 6.0 | 7.0 | 6.0 | 7.0 | 6.0 | 7.0 |
| HEDP | — | 0.16 | 0.16 | — | 0.16 | 0.16 | 0.16 |
| DTPMP | 0.18 | — | — | 0.18 | — | — | — |
| Propyl gallate | 0.1 | 0.1 | 0.1 | 0.3 | 0.1 | 0.1 | 0.1 |
| Citric acid | 0.05 | 0.05 | 0.05 | 0.05 | 0.05 | 0.05 | 0.05 |
| Water and minors | - - - up to 100% - - - | | | | | | |
| pH (neat product) | 5 | 5 | 5 | 5 | 4 | 4 | 4 |

| Compositions (% weight) | XVI | XVII | XVIII | XIX | XX | XXI | XXII | XXIII |
|---|---|---|---|---|---|---|---|---|
| Dobanol ® 91-10 | — | 1.6 | — | — | — | — | 1.6 | — |
| Dobanol ® 45-7 | 1.6 | — | 2.6 | 1.6 | 2.0 | 1.6 | — | 2.0 |
| Dobanol ® 23-3 | 1.5 | 2.0 | 1.0 | 2.0 | 2.0 | 2.0 | 2.0 | — |
| Glucose amide* | 1.5 | 1.5 | — | 1.5 | 1.5 | — | — | — |
| C25-AE3-S | 2.0 | 2.0 | — | 2.0 | 1.0 | — | — | — |
| Lauryl Betaine | — | — | 2.4 | — | — | 5.0 | 5.0 | 5.0 |
| Coconut fatty acid | 0.1 | 0.1 | 0.25 | 0.25 | 0.1 | 0.25 | 0.25 | 0.1 |
| Capped alcohol* | 0.1 | — | 0.25 | — | 0.4 | — | 0.25 | 0.4 |
| Silicone emulsion 2-3597 ® | 0.004 | 0.004 | 0.004 | 0.004 | 0.004 | 0.004 | 0.004 | 0.004 |
| $H_2O_2$ | 6.0 | 7.0 | 6.0 | 7.0 | 7.0 | 7.0 | 7.0 | 7.0 |
| HEDP | 0.16 | 0.16 | 0.16 | 0.16 | — | 0.16 | 0.16 | 0.16 |
| DTPMP | — | — | — | — | 0.18 | — | — | — |
| BHT | 0.1 | 0.1 | 0.1 | 0.1 | 0.3 | 0.1 | 0.1 | 0.1 |
| Citric acid | 0.05 | 0.05 | 0.50 | 0.05 | 0.05 | 0.05 | 0.05 | 0.05 |
| Water and minors | - - - up to 100% - - - | | | | | | | |
| pH (neat product) | 5 | 5 | 5 | 4 | 4 | 5 | 4 | 6 |

Compositions I to XXIII when used to clean soiled colored fabrics exhibit excellent overall stain removal performance, especially on greasy stains like lipstick, make-up, olive oil, mayonnaise, sebum and the like, and excellent bleaching performance.

When used in a pretreatment mode, any of the compositions I to XXIII is applied neat on the stained portion of a fabric and left to act thereon for 5 minutes. Then the fabric is washed with a conventional detergent and rinsed.

When used in a bleaching-through-the-wash mode, any of the compositions I to XXIII is contacted with an aqueous bath formed by dissolution of a conventional detergent in water. Fabrics are then contacted with the aqueous bath comprising the liquid detergent, and the fabrics are rinsed. They can also be used in a soaking mode, where 100 ml of the liquid compositions are diluted in 10 liters of water. The fabrics are then contacted with this aqueous bath containing the composition, and left to soak therein for a period of time of 24 hours. The fabrics are eventually rinsed.

Compositions I to XXIII when used to clean soiled hard-surfaces exhibit excellent overall stain removal performance especially on kitchen dirt greasy stains.

All these compositions exhibit low foaming properties and thus are easily rinsed away from the surface to which they have been contacted.

What is claimed is:

1. A liquid composition having a pH below 7, and comprising a peroxygen bleach, a surfactant that exhibits a foaming property in the presence of the peroxygen bleach, and a foam reducing system comprising a fatty acid together with a capped alkoxylated nonionic surfactant of formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, $R_2$ is a $C_1$–$C_{10}$ linear or branched alkyl group, $R_3$ is a $C_1$–$C_{10}$ alkyl or alkenyl group and n and m are integers independently ranging from 1 to 20, and a silicone.

2. The composition according to claim 1 wherein said peroxygen bleach comprises hydrogen peroxide and/or a water soluble source thereof.

3. The composition according to claim 1 wherein the composition comprises from about 0.01% to about 20% by weight of the total composition of said peroxygen bleach.

4. The composition according to claim 3 wherein the composition comprises from about 1% to about 15% by weight of the total composition of said peroxygen bleach.

5. The composition according to claim 4 wherein the composition comprises from about 2% to about 10% by weight of the total composition of said peroxygen bleach.

6. The composition according to claim 1 wherein the composition comprises from about 0.01% to about 60% by weight of the total composition of said surfactant.

7. The composition according to claim 6 wherein the composition comprises from about 0.1% to about 30% by weight of the total composition of said surfactant.

8. The composition according to claim 7 wherein the composition comprises from about 0.5% to about 15% by weight of the total composition of said surfactant.

9. The composition according to claim 1 wherein said surfactant comprises a nonionic surfactant and/or a zwitterionic surfactant.

10. The composition according to claim 9 wherein said nonionic surfactant comprises an alkoxylated nonionic surfactant having the formula:

$$RO—(C_2H_4O)_nH$$

wherein R is a $C_6$–$C_{22}$ alkyl chain or a $C_6$–$C_{28}$ alkyl benzene chain and n is an integer of from about 0 to about 20; and/or an amine oxide surfactant and/or a polyhydroxy fatty acid amide surfactant.

11. The composition according to claim 9 wherein said zwitterionic surfactant comprises a zwitterionic betaine surfactant having the formula:

$$R_1—N^+—(R_2)(R_3)R_4X^-$$

wherein $R_1$ is an aliphatic or aromatic, saturated or unsaturated, substituted or unsubstituted hydrocarbon chain that can contain linking groups; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to a hydrophilic group; and $X^-$ is a carboxylate or sulfonate group.

12. The composition according to claim 1 wherein said fatty acid comprises an alkali salt of a $C_8$–$C_{24}$ fatty acid.

13. The composition according to claim 1 wherein said silicone comprises a siloxane having the formula:

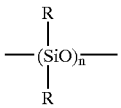

wherein n is from about 20 to about 2000 and each R is independently an alkyl or an aryl radical.

14. The composition according to claim 1 wherein said foam reducing system comprises the fatty acid and capped alkoxylated nonionic surfactant at a weight ratio of the fatty acid to the capped alkoxylated nonionic surfactant of from about 0.01 to about 10.

15. The composition according to claim 14 wherein said foam reducing system comprises the fatty acid and capped alkoxylated nonionic surfactant at a weight ratio of the fatty acid to the capped alkoxylated nonionic surfactant of from about 0.1 to about 5.

16. The composition according to claim 1 wherein said foam reducing system comprises the fatty acid and the silicone at a weight ratio of the fatty acid to the silicone of from about $1\times10^4$ to about $1\times10^-$.

17. The composition according to claim 16 wherein said foam reducing system comprises the fatty acid and the silicone at a weight ratio of the fatty acid to the silicone of from about $1\times10^4$ to about 1.

18. The composition according to claim 1 wherein said foam reducing system comprises the fatty acid, the capped alkoxylated nonionic surfactant and the silicone at a weight ratio of the fatty acid to the capped alkoxylated nonionic surfactant to the silicone of from about $1:1\times10^3$: $1\times10^{-5}$ to about 10:1:1.

19. The composition according to claim 18 wherein said foam reducing system comprises the fatty acid, the capped alkoxylated nonionic surfactant and the silicone at a weight ratio of the fatty acid to the capped alkoxylated nonionic surfactant to the silicone of from about $1:1\times10^2$: $1\times10^{-4}$ to about 1:1:1.

20. The composition according to claim 1 wherein said composition further comprises a chelating agent.

21. The composition according to claim 20 wherein the chelating agent comprises a phosphonate chelating agent and/or an amino carboxylate chelating agent and/or a non-amino carboxylate chelating agent and/or a polyfunctionally-substituted aromatic chelating agent and/or ethylenediamine N,N'-disuccinic acid.

22. The composition according to claim 1 wherein said composition further comprises at least an optional ingredient selected from the group consisting of: builders, stabilizers, bleach activators, soil suspenders, soil suspending polyamine polymers, polymeric soil release agents, radical scavengers catalysts, dye transfer agents, solvents, brighteners, perfumes, dyes, pigments and mixtures thereof.

23. A process for cleaning fabrics which includes the steps of diluting in an aqueous bath a liquid composition according to claim 1, in its neat form, contacting said fabrics with said aqueous bath comprising said liquid composition, and subsequently rinsing and/or washing then rinsing said fabrics.

24. The process according to claim 23 wherein the fabrics are left to soak in said aqueous bath comprising said liquid composition for a period of time ranging from about 1 minute to about 48 hours.

25. The process according to claim 24 wherein the fabrics are left to soak in said aqueous bath comprising said liquid composition for a period of time ranging from about 1 hour to about 24 hours.

26. The process according to claim 23 wherein said aqueous bath is formed by dissolving and/or dispersing a conventional laundry detergent in water.

27. A process for pretreating fabrics which comprises the steps of applying a liquid composition according to claim 1, in its neat form, onto said fabrics.

28. A process for cleaning a hard surface which comprises the steps of applying a liquid composition according to claim 1, in its neat form, to said hard surface.

* * * * *